US010634157B2

(12) United States Patent
Rubino et al.

(10) Patent No.: US 10,634,157 B2
(45) Date of Patent: Apr. 28, 2020

(54) CENTRIFUGAL COMPRESSOR IMPELLER WITH NON-LINEAR LEADING EDGE AND ASSOCIATED DESIGN METHOD

(71) Applicant: Nuovo Pignone Srl, Florence (IT)

(72) Inventors: Dante Tommaso Rubino, Florence (IT); Emanuele Guidotti, Florence (IT); Satish Koyyalamudi, Bangalore (IN)

(73) Assignee: Nuovo Pignone Srl, Florence (IT)

( * ) Notice: Subject to any disclaimer, the term of this patent is extended or adjusted under 35 U.S.C. 154(b) by 435 days.

(21) Appl. No.: 15/108,770

(22) PCT Filed: Jan. 7, 2015

(86) PCT No.: PCT/EP2015/050149
§ 371 (c)(1),
(2) Date: Jun. 28, 2016

(87) PCT Pub. No.: WO2015/104282
PCT Pub. Date: Jul. 16, 2015

(65) Prior Publication Data

US 2016/0319833 A1 Nov. 3, 2016

(30) Foreign Application Priority Data

Jan. 7, 2014 (IT) ..... FI2014A0002

(51) Int. Cl.
*F04D 29/30* (2006.01)
*F04D 29/28* (2006.01)
(Continued)

(52) U.S. Cl.
CPC ..... *F04D 29/30* (2013.01); *F04D 17/122* (2013.01); *F04D 29/284* (2013.01); *F04D 29/441* (2013.01); *F05D 2240/303* (2013.01)

(58) Field of Classification Search
CPC .... F04D 29/384; F04D 29/386; F04D 29/242; F04D 29/284; F04D 29/28; F04D 29/30;
(Continued)

(56) References Cited

U.S. PATENT DOCUMENTS 5,730,582 A * 3/1998 Heitmann ..... B63H 11/08 416/185
8,277,187 B2 * 10/2012 Schluter ..... F04D 29/284 416/188
(Continued)

FOREIGN PATENT DOCUMENTS

CN 102341602 A 2/2012
DE 10 2012 004 388 A1 9/2013
(Continued)

OTHER PUBLICATIONS

International Search Report and Written Opinion dated Mar. 12, 2015 which was issued in connection with PCT Patent Application No. PCT/EP2015/050149 which was filed on Jan. 7, 2015.
(Continued)

*Primary Examiner* — Brian P Wolcott
(74) *Attorney, Agent, or Firm* — Baker Hughes Patent Organization

(57) ABSTRACT

A centrifugal compressor impeller comprises a gas inlet, a gas outlet, and a disc having a plurality of blades extending therefrom. Each blade has a leading edge at the impeller inlet and a trailing edge at the impeller outlet, a blade base extending along the disc between the leading edge and the trailing edge, a blade tip extending between the leading edge and the trailing edge opposite the disc, a pressure side and a suction side. Each blade has a three-dimensional curvature in at least a portion of the surface, adjacent the leading edge. The leading edge has a curved, non-linear profile in a meridian plane. The blade portion has a double-curvature. Each blade has a first metal angle distribution at the blade
(Continued)

base, a second metal angle distribution at the blade tip and at least a third metal angle distribution between the blade base and the blade tip.

17 Claims, 7 Drawing Sheets

(51) Int. Cl.
*F04D 17/12* (2006.01)
*F04D 29/44* (2006.01)

(58) Field of Classification Search
CPC ..... F04D 29/441; F04D 17/122; F05D 2240/305; F05D 2240/306; F05D 2250/71; F05D 2250/711; F05D 2250/712; F05D 2240/303
See application file for complete search history.

(56) References Cited

U.S. PATENT DOCUMENTS

| | | | | |
|---|---|---|---|---|
| 8,951,009 | B2 * | 2/2015 | Swiatek | F04D 29/30 415/204 |
| 9,157,450 | B2 * | 10/2015 | Sugimura | F04D 29/30 |
| 2009/0220346 | A1 | 9/2009 | Schluter et al. | |
| 2012/0263599 | A1 | 10/2012 | Sugimura et al. | |

FOREIGN PATENT DOCUMENTS

| | | | | |
|---|---|---|---|---|
| DE | 102012004388 | * | 9/2013 | F04D 29/284 |
| DE | 102012004388 | A1 | 9/2013 | |
| JP | H09296799 | A | 5/1996 | |
| JP | 2002332993 | A | 5/2001 | |
| RU | 54 113 | U1 | 6/2006 | |

OTHER PUBLICATIONS

Italian Search Report and Written Opinion dated Sep. 22, 2014 which was issued in connection IT Patent Application No. FI2014A000002 which was filed on Jan. 7, 2014.

Machine Translation and First Office Action and Search issued in connection with corresponding CN Application No. 201580003959.3 dated Jun. 4, 2018.

Office Action and Search Report issued in connection with corresponding RU Application No. 2016125715 dated Jul. 16, 2018 (English Translation not available).

Machine Translation and Notification of Reasons for Refusal issued in connection with corresponding JP Application No. 2016-544404 dated Nov. 20, 2018.

* cited by examiner

Fig.1B
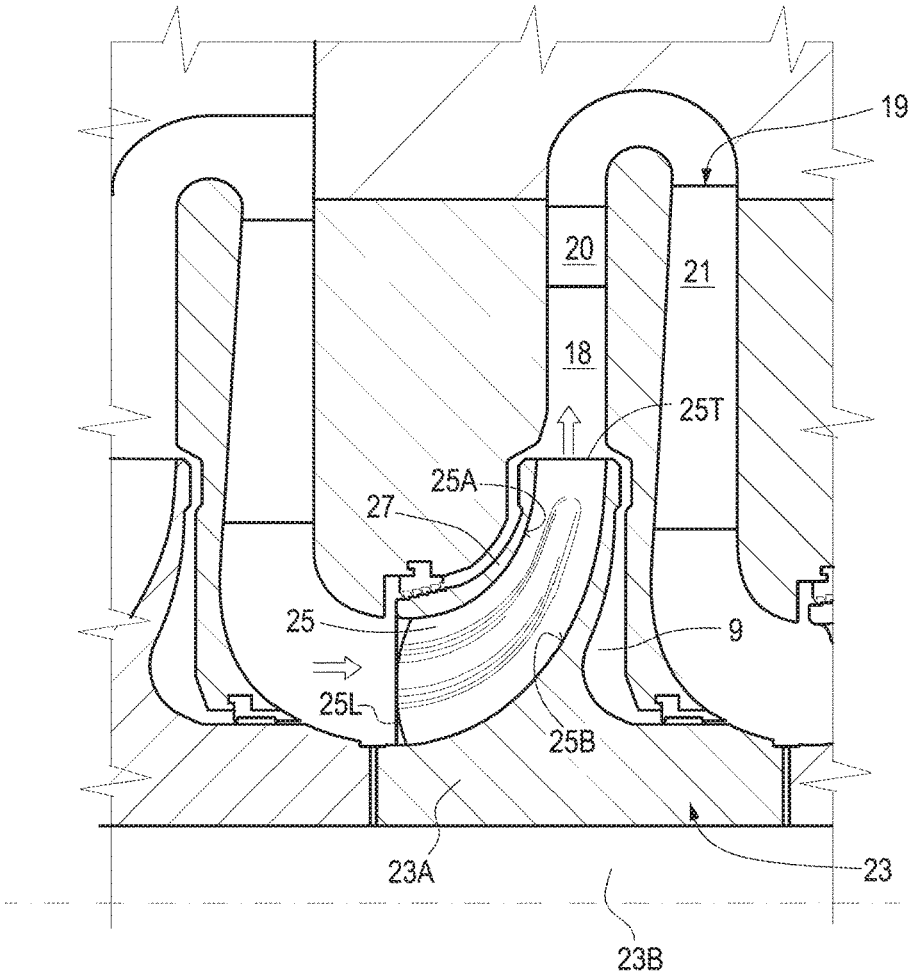
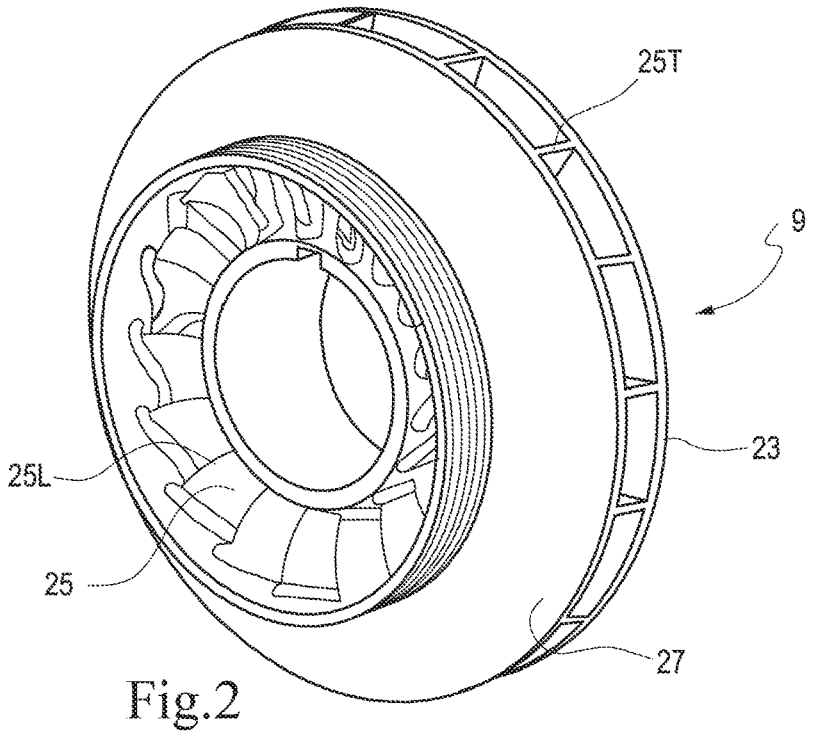
Fig.2

CENTRIFUGAL COMPRESSOR IMPELLER WITH NON-LINEAR LEADING EDGE AND ASSOCIATED DESIGN METHOD

TECHNICAL FIELD

The subject matter disclosed herein relates to compressors and more specifically to centrifugal compressors.

BACKGROUND

Centrifugal compressors convert mechanical energy provided by a driver, such as an electric motor, a gas turbine, a steam turbine or the like, into pressure energy for boosting the pressure of a gas processed by the compressor. A compressor essentially comprises a casing rotatingly housing a rotor and a diaphragm. The rotor can be comprised of one or more impellers, which are driven into rotation by the prime mover. The impellers are provided with blades having a broadly axial inlet section and a broadly radial outlet section. Flow channels are delimited by the blades and by a back plate or disc of the impeller. In some compressors, the impeller is provided with a shroud, opposite the back plate or disc, the blades extending between the back plate or disk and the shroud. Gas enters the flow channels of each impeller axially, is accelerated by the blades of the impeller and exit the impeller radially or in a mixed radial-axial fashion in the meridian plane. Accelerated gas is delivered by each impeller through a circumferentially arranged diffuser where the kinetic energy of the gas is at least partly converted in pressure energy, increasing the gas pressure.

The quantity of energy provided by the prime mover and absorbed by the compressor cannot be entirely converted into useful pressure energy, i.e. in pressure increment in the fluid, due to dissipation phenomena of various kinds involving the compressor as a whole.

BRIEF DESCRIPTION

According to one aspect, the present disclosure concerns a centrifugal compressor impeller, which has a plurality of blades having a three-dimensional, non-ruled surface portion in a region starting at the leading edge. More specifically, each blade has a leading edge which is non-linear in the meridian plane, and a blade surface on both the suction side and the pressure side having a double curvature at least in a region adjacent the leading edge.

Some embodiments of the subject matter disclosed herein provide for a compressor impeller comprising a gas inlet, a gas outlet and a disc having a plurality of blades extending therefrom. Each blade has a leading edge at the impeller inlet, a trailing edge at the impeller outlet, a blade base extending along the disc between the leading edge and the trailing edge, a blade tip extending between the leading edge and the trailing edge opposite the disc, a pressure side and a suction side. The leading edge of each blade has a curved, non-linear profile in the meridian plane. Starting at the leading edge and moving towards the trailing edge each blade has a first metal angle distribution at the blade base, a second metal angle distribution at the blade tip and at least a third metal angle distribution at an intermediate location between the blade base and the blade tip. The third metal angle distribution is selected as a function of the non-linear profile of the leading edge. At least a blade portion starting at the leading edge is thus provided with a double curvature.

The non-linear profile of the leading edge can be convex and the third metal angle distribution is selected such that in the intermediate location the blade has a double curvature with a convex surface on the suction side and a concave surface on the pressure side at least in a region adjacent the leading edge.

According to other embodiments the blades of the impeller can have each a leading edge having a non-linear profile which is concave in the meridian plane, wherein the third metal angle distribution is selected so that in the intermediate location the blade has a double curvature with a convex surface on the pressure side and a concave surface on the suction side at least in a region adjacent the leading edge.

According to a further aspect, the disclosure concerns a centrifugal compressor comprising at least one impeller as set forth here above.

The disclosure also concerns a method for designing a compressor impeller with a plurality of impeller blades, comprising the following steps:

- defining a blade base profile, along an impeller disk, and a blade tip profile in a meridian plane of the blades;
- defining a pressure side surface and a suction side surface of the blades extending between the blade base profile and the blade tip profile, the pressure side surface and the suction side surface extending between a trailing edge and a non-linear leading edge, which is curved in the meridian plane;
- imparting to each blade, starting from the leading edge towards the trailing edge, a first metal angle distribution at the blade base, a second metal angle distribution at the blade tip and at least a third metal angle distribution at an intermediate location between the blade base and the blade tip, wherein the third metal angle distribution is selected as a function of the non-linear profile of the leading edge, a blade portion adjacent to the leading edge having a double curvature.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the embodiments of the present invention. It is important, therefore, that the claims be regarded as including such equivalent constructions insofar as they do not depart from the spirit and scope of the embodiments of the present invention.

BRIEF DESCRIPTION OF THE DRAWINGS

A more complete appreciation of the disclosed embodiments of the invention will be readily obtained as the same becomes better understood by reference to the following detailed description when considered in connection with the accompanying drawings, wherein:

FIG. 1B illustrates an enlargement of an impeller blade of the compressor of FIG. 1A;

FIG. 2 illustrates a perspective view of an impeller of the centrifugal compressor of FIG. 1A;

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit embodiments of the invention. Instead, the scope of the embodiments is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1A:
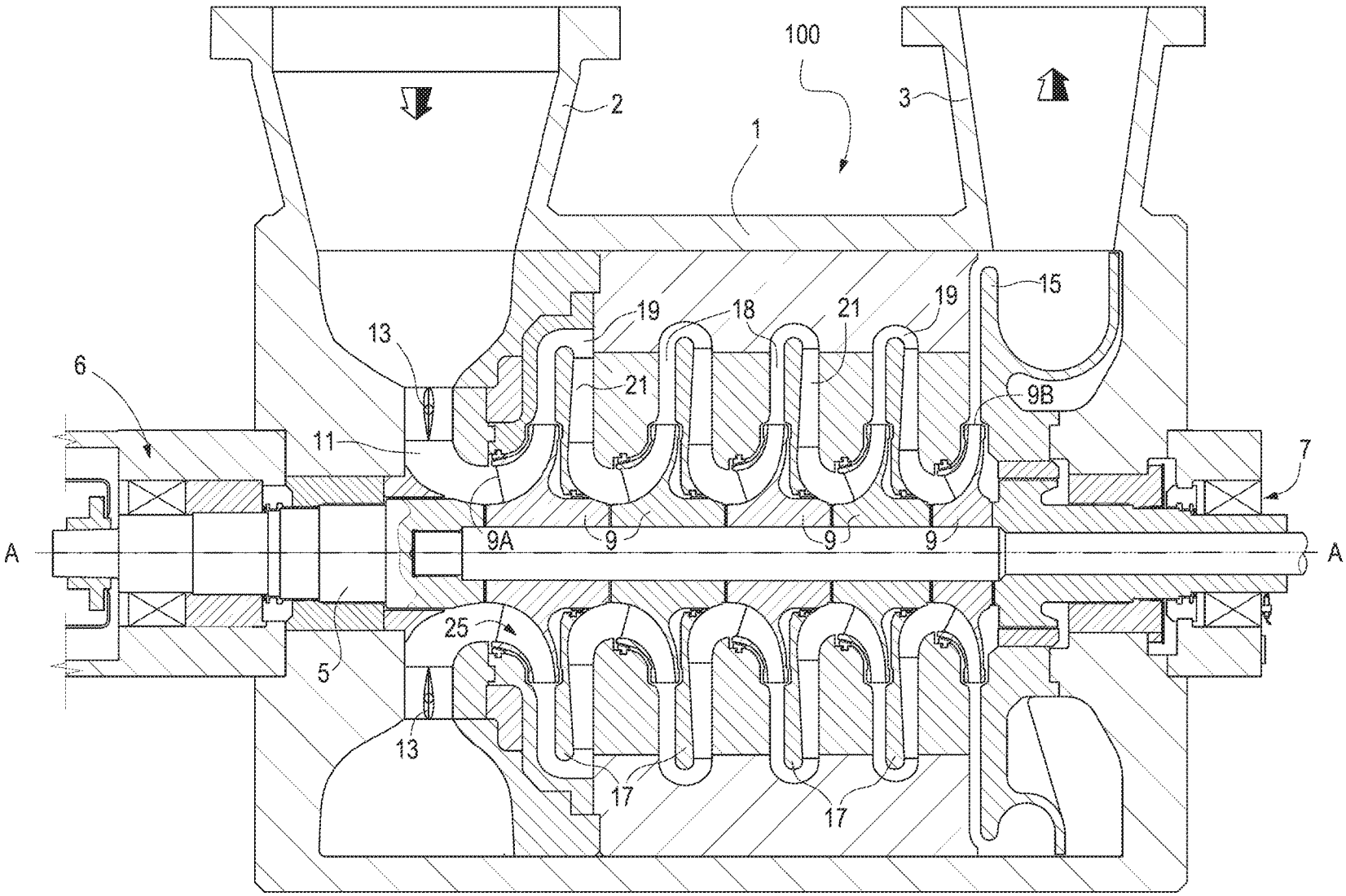
FIG. 1A illustrates a longitudinal section of a multi-stage centrifugal compressor, wherein impellers according to the present disclosure can be used.

FIGS. 1A and 1B illustrate an exemplary embodiment of a multistage centrifugal compressor, globally labeled 100, wherein the subject matter disclosed herein can be embodied. FIG. 1A illustrates a sectional view according to a plane containing a rotation axis A-A of the compressor and FIG. 1B illustrates an enlargement of one compressor stage.

The compressor 100 has an outer casing 1 provided with an inlet manifold 2 and an outlet manifold 3. Inside the casing 1 several components are arranged, which define a plurality of compressor stages.

More specifically, the casing 1 houses a compressor rotor. The compressor rotor is comprised of a rotor shaft 5. The rotor shaft 5 can be supported by two end bearings 6, 7. The compressor rotor further comprises at least one impeller. In some embodiments, as shown in FIG. 1A, the compressor rotor comprises a plurality of impellers 9, one impeller for each compressor stage. The impellers 9 are arranged between the two bearings 6, 7.

The inlet 9A of the first impeller 9 is in fluid communication with an inlet plenum 11, wherein gas to be compressed is delivered through the inlet manifold 2. In some embodiments, the gas flow enters the inlet plenum 11 radially and is then delivered through a set of movable inlet guide vanes 13 and enters the first impeller 9 in a substantially axial direction.

According to the exemplary embodiment of FIG. 1A, the outlet 9B of the last impeller 9 is in fluid communication with a volute 15, which collects the compressed gas and delivers it towards the outlet manifold 3.

Stationary diaphragms 17 are arranged between each pair of sequentially arranged impellers 9. Diaphragms 17 can be formed as separate, axially arranged components. In other embodiments, the diaphragms 17 can be formed in two substantially symmetrical halves. Each diaphragm 17 defines a diffuser 18 and a return channel 19, which extend from the radial outlet of the respective upstream impeller 9 to the inlet of the respective downstream impeller 9. In the diffuser 18 the gas flow is slowed and kinetic energy transferred from the impeller to the gas is converted into pressure energy, thus increasing the gas pressure.

The return channel 19 returns the compressed gaseous flow from the outlet of the upstream impeller towards the inlet of the downstream impeller. In some embodiments, fixed blades 20 can be arranged in the diffuser 18. In some embodiments, fixed blades 21 can be provided in the return channels 19, for removing the tangential component of the flow while redirecting the compressed gas from the upstream impeller to the downstream impeller.

As best shown in FIG. 1B, where an enlargement of one of the several compressor stages of compressor 100 is shown, and in FIG. 2, where an exemplary impeller is illustrated in an axonometric view, each impeller 9 is comprised of a disc 23 defining a hub portion 23A. The hub portion 23A has a bore 23B, through which the rotor shaft 5 extends. The disc 23 is sometimes also named hub as a whole. A plurality of blades 25 extend from the disc 23 and define flow channels, through which the gas flows and is accelerated by the blades 25. Each blade has a leading edge 25L and a trailing edge 25T arranged respectively at the inlet and at the outlet of the blade. In some embodiments, the impeller 9 can be open. In other embodiments the impeller can be closed by a shroud 27, arranged opposite the disc 23, the blades 25 extending between disc 23 and shroud 27.

Each blade 25 is provided with a blade tip 25A extending along the shroud 27, between the leading edge 25L and the trailing edge 25T. Each blade 25 is further provided with a blade base or blade root 25B extending along the disc 23 between the leading edge 25L and the trailing edge 25T.

Figure 3:
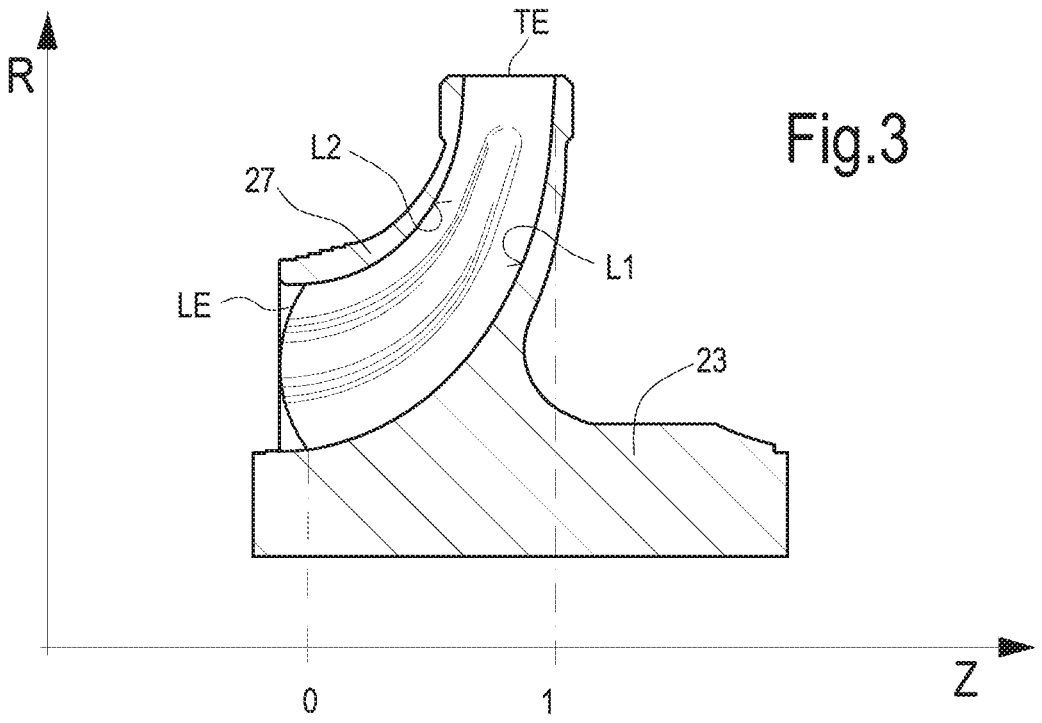
FIG. 3 illustrates a schematic diagram of a projection of a blade in a meridian plane.

Each blade 25 has a suction side and a pressure side and the shape of the blade is defined in the manner described here below, starting from the intersection of the centerline or camber line of the blade 25 with the disc 23 and shroud 27, respectively. FIG. 3 shows a projection of a generic blade 25 in a meridian plane, i.e. the plane R-Z, where R is the radial direction and Z is the axial direction. L1 is the projection on the meridian plane R-Z of the center line, i.e. camber line of the blade profile at the disc or hub 23. L2 is the projection on the same meridian plane R-Z of the center line, i.e. camber line of the blade profile, at the shroud 27.

If the impeller is unshrouded, i.e. open, the line L2 is the projection of the center line of the blade profile at the blade tip.

The lines L1 and L2 are therefore the projections of the blade profiles in the R-Z plane (meridian plane) at disk and shroud, i.e. at the blade base and blade tip, respectively. In FIG. 3 the projection of the trailing edge 25T and of the leading edge 25L of the blade are also represented.

As noted above, the impeller 9 can be shrouded as shown in the exemplary embodiment illustrated in the drawings. However, in other embodiments, not shown, the impeller 9 is open and the shroud 27 is not provided. In this case line L2 is simply the projection of the camber line or center line at the blade tip 25A on the meridian plane R-Z.

These lines L1 and L2 are the starting points for designing the three-dimensional surfaces of the suction side and pressure side of the blade, as follows.

Starting from the two lines L1 and L2, the actual shape of the opposite surfaces of the blade 25, defining the suction side and the pressure side of the blade are determined by means of two additional parameters, namely the blade thickness and the blade metal angle. Both parameters are defined for a plurality of positions along each line L1 and L2. In some embodiments, blade metal angle and blade thickness can have different values for line L1 and line L2.

Figure 4:
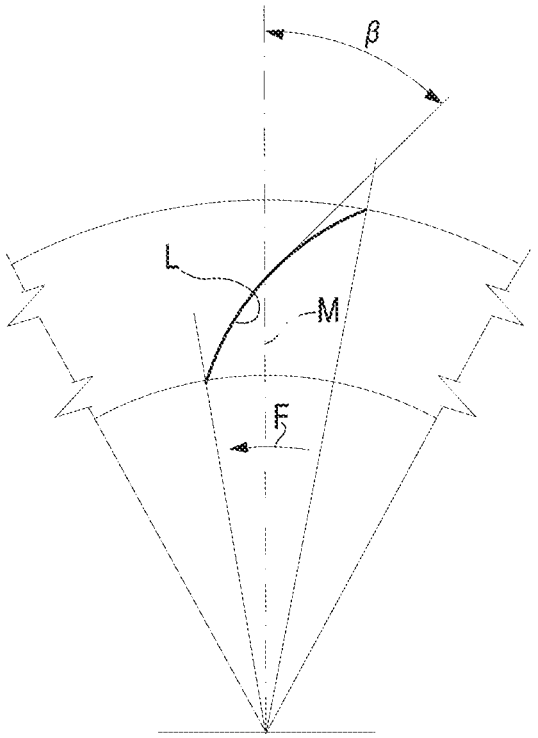
FIG. 4 illustrates the projection of the blade camberline (at a given spanwise location) on the plane perpendicular to the axial direction.

The blade metal angle distribution, i.e. the metal angle β in each point of line L1 or L2 considered is defined as the angle between the tangent to the line L1 or L2 and the meridian direction (M), as shown in FIG. 4, which illustrates a schematic front view of the impeller, and L is the generic centerline considered. Arrow F indicates the direction of rotation of the impeller. Conventionally, the sign of the angle β is concordant with the direction of rotation of the impeller. Thus, in the example of FIG. 4 the angle β is negative, as it is measured starting from the meridian direction M and is opposite the direction of rotation of the impeller (arrow F). In terms of mathematical formulae, the metal angle β is defined as follows:

$$tg\beta = R\frac{d\theta}{dm}$$

where θ is the tangential coordinate, i.e. the coordinate along the tangential direction, and m is the meridian coordinate, i.e. the coordinate along the abscissa in FIG. 3.

Figure 5:
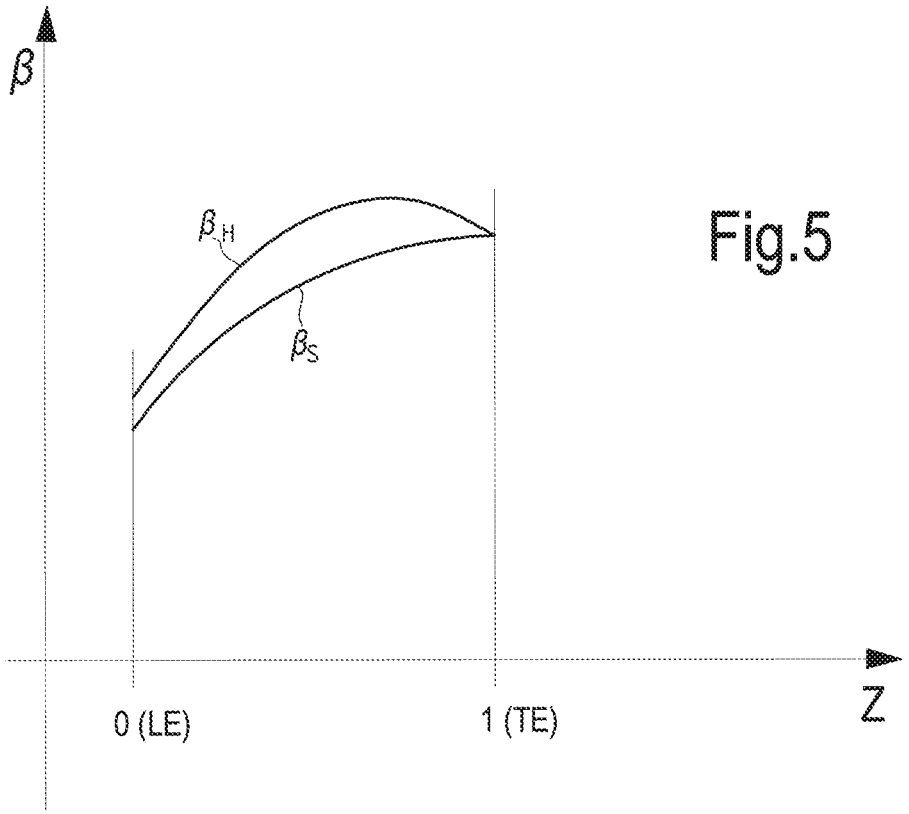
FIGS. 5 and 6 illustrate diagrams representing the distribution of blade metal angle and blade thickness (referring to the blade of FIG. 3) along the meridional direction.
Figure 6:
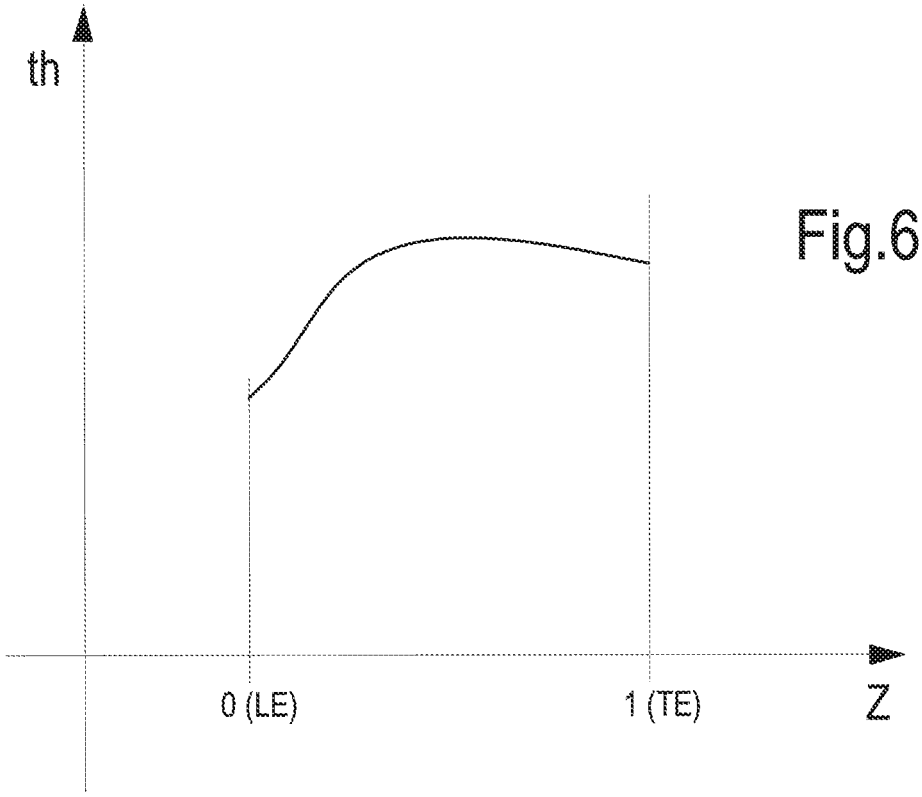

The thickness (th) of the blade is defined as the distance between the suction side surface and the pressure side surface of the blade from the camber line (i.e. the central line) of the blade at each point of the curve L2 or L2 considered. FIGS. 5 and 6 illustrate schematically the distribution of the metal angle (β) and the thickness (th) for an exemplary blade. On the horizontal axis of the diagrams of FIGS. 5 and 6 the normalized coordinate along the meridian direction is plotted. Coordinate "0" indicates the position at the leading edge and coordinate "1" indicates the position at the trailing edge of the blade.

In the exemplary diagram of FIG. 5 the metal angle distribution along the curve L1 at the impeller disc or hub is different from the metal angle distribution along the curve L2, at the impeller shroud or at the blade tip. The metal angle distribution along the disc or hub is labeled $\beta_H$, while the metal angle distribution along the shroud is labeled $\beta_S$. In other embodiments the metal angle distributions at shroud and disc can be identical. According to the current art, the metal angle distribution at an intermediate location between disc and shroud is not defined.

The combination of the above defined parameters gives the profile of the blade at the blade tip 25A and at the blade base 25B. The next step for defining the surface of the pressure side and suction side of the blade is now the generation of two opposite ruled surfaces starting from the two blade profiles at the blade tip 25A and blade base 25B as defined above. The ruled surfaces are generated by connecting each point of the blade tip profile with a corresponding point of the blade base profile with a rectilinear (straight) line.

The geometry of the blade is not yet completely defined, as the curves L1 and L2 and the corresponding blade tip and blade base profiles are usually shifted, i.e. displaced one with respect to the other, in the tangential direction, rotating the blade tip profile and blade base profile one with respect to the other around the rotation axis of the impeller. A further degree of freedom is therefore available for the full definition of the blade geometry, given by the possible tangential displacement of the two curves L1 and L2. In the impellers of the current art, the two curves L1 and L2 are tangentially shifted, i.e. rotated one with respect to the other around the impeller axis, thus inclining the trailing edge 25T with respect to the axial direction (for an impeller with purely radial exit) maintaining its rectilinear (straight) shape. The inclination of the trailing edge with respect to the axial direction, named angle of lean, defines, along with the above mentioned parameters, the entire geometry of the blade.

The resulting blade surfaces are still ruled surfaces, i.e. they are characterized by a single curvature.

According to the subject matter disclosed herein, a further degree of freedom is introduced for designing the impeller blade as described here below, so that at least a portion of the suction side surface and pressure side surface of the blade have a double curvature, i.e. become non-ruled surface portions. Moreover, according to the present disclosure, the leading edge of the blade has a non-linear shape in the meridian plane.

Figure 7:
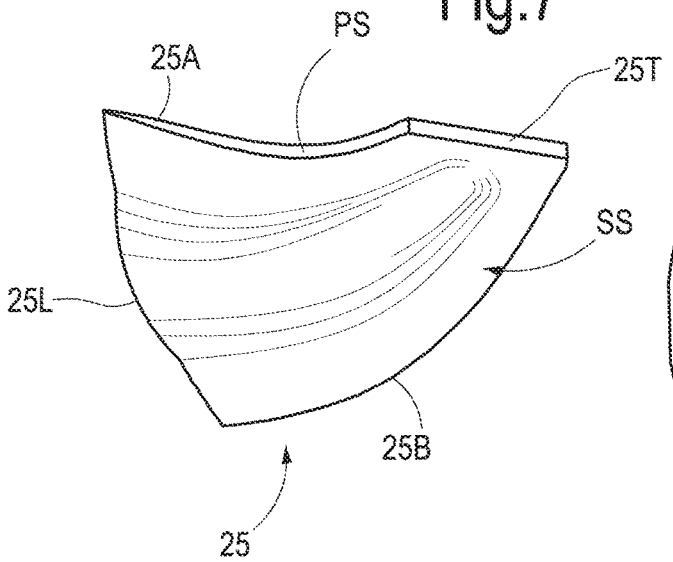
FIG. 7 illustrates a perspective view of a three-dimensional blade according to the present disclosure.

According to some embodiments, the leading edge of the blade has a convex shape in the meridian plane, as shown in FIG. 7. In this way the leading edge LE of each blade extends upstream towards the direction wherefrom the gas flow enters the impeller. Consequently, a better guidance of the incoming gas flow is obtained, which reduces flow losses and beneficially affects the efficiency of the impeller.

On the other hand, since a convex shape of the leading edge in the meridian plane RZ would reduce the cross section of the inlet of each vane defined between two adjacent blades 25, according to a further aspect of the disclosure, the metal angle distribution of the blade is modified with respect to current art metal angle distribution, in order to compensate for the effect of the convex shape of the leading edge. Differently from current art design, the metal angle along the leading edge is not determined by linear interpolation between the metal angle values at the shroud and disc respectively. Rather, the metal angle at mid-span is modified such that the reduction of the cross section of the vane inlet determined by the convex shape of the leading edge is compensated by increasing the metal angle at an intermediate location along the blade span, i.e. between the line L1 and the line L2. More specifically, the metal angle at mid-span, i.e. in an intermediate location between shroud (blade tip) and disc (blade base), is modified so that the blade becomes convex on the suction side (SS) and concave at the pressure side (PS).

Figure 8:
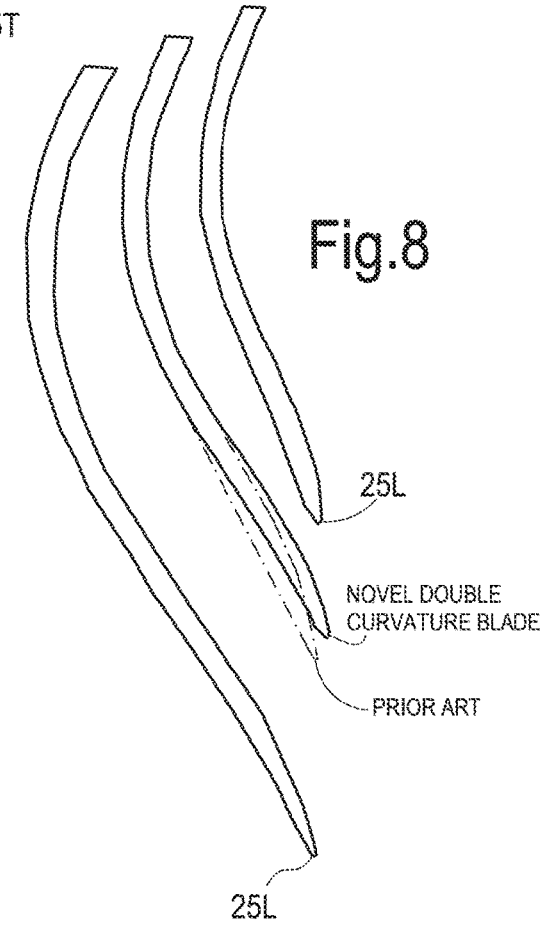
FIG. 8 diagrammatically illustrates a sectional view of the blade in three different locations between the blade tip and the blade base.

In FIG. 7 the effect of the combination of non-linear leading edge 25L and non-linear metal angle distribution along the leading edge on the overall shape of a single blade 25 is shown. The suction side surface has a portion with a double curvature, which is convex, while the opposite pressure side surface is correspondingly concave. FIG. 8 shows the cross section of the blade 25 at the disc, shroud and mid-span. In the mid-span section two profiles are plotted: one profile corresponds to a current art design, where the metal angle is determined by linear interpolation between the metal angle at the shroud and at the disc of the blade; the other profile corresponds to the modified design according to the present disclosure, where the blade takes a shape with a double curvature and the metal angle has been "opened" at mid-span.

Figure 9:
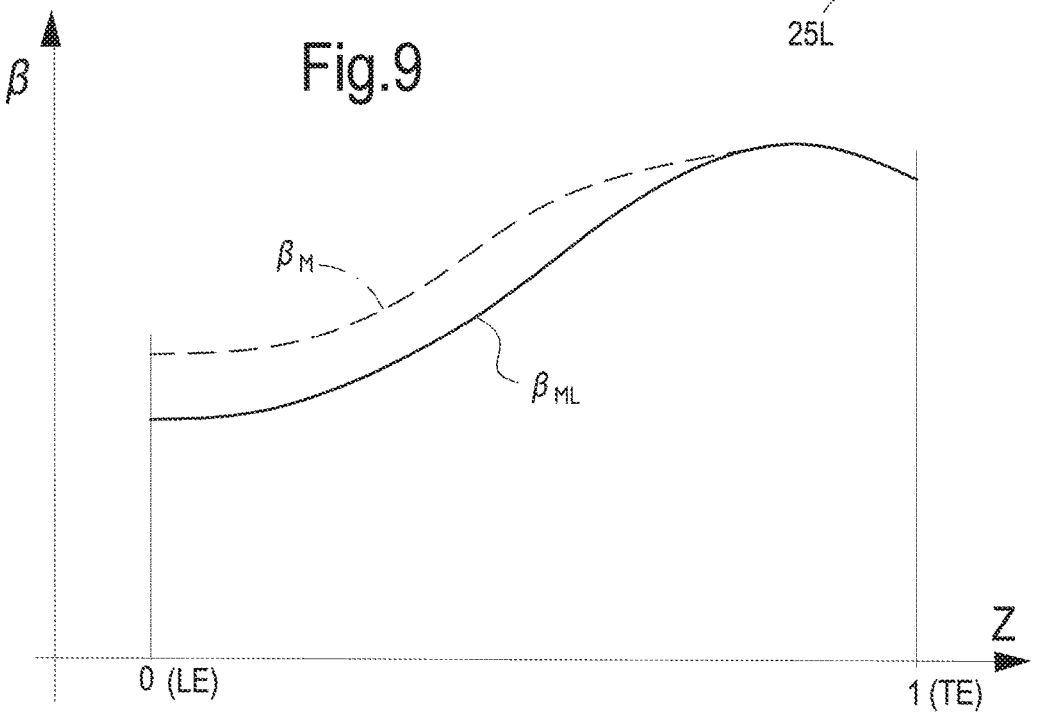
FIG. 9 illustrates a diagram of the metal angle distribution at mid-span along the meridian coordinate of the blade, in a design according respectively to the current art and to the present disclosure, for a blade according to FIG. 7.

FIG. 9 illustrates a diagram similar to the diagram of FIG. 5, wherein the metal angle distribution at mid-span is plotted. The horizontal axis reports the normalized meridian coordinate and the vertical axis reports the metal angle values. Curve $\beta_{ML}$ shows the metal angle distribution at mid-span corresponding to the mid-span profile (obtained by connection of disc and shroud profiles, as previously described) according to the state of the art design. Curve $\beta_M$ represents the metal angle distribution at mid-span according to the present disclosure. As shown in FIG. 9, the metal angle at mid-span is larger ("more open") than in usual, current art design, for at least a portion of the meridian extension of the blade, starting from the leading edge, to compensate for the reduction of the flow cross section at the impeller inlet caused by the non-linear, convex shape of the leading edge 25L.

Figure 10:
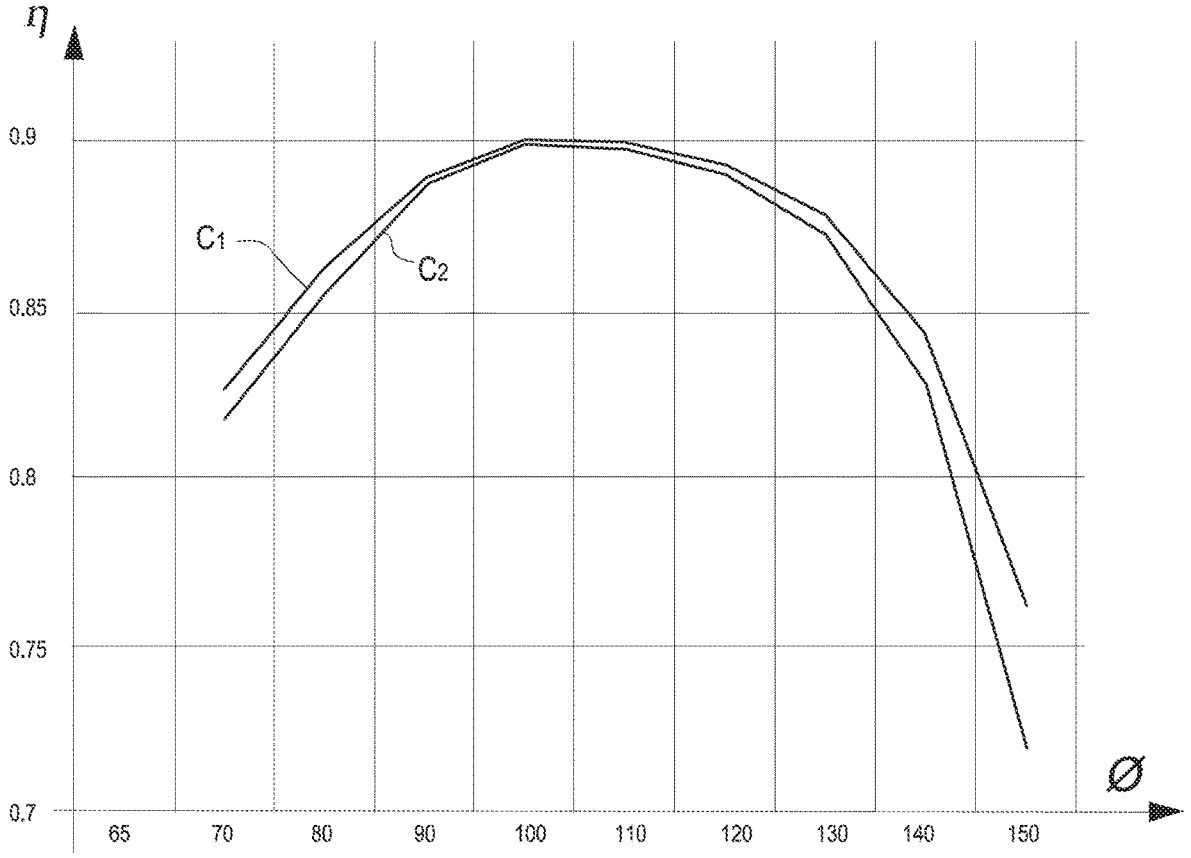
FIG. 10 illustrates a diagram of the polytropic efficiency versus flow coefficient of an impeller of the current art and of an impeller according to the present disclosure.

FIG. 10 illustrates the effect of the non-linear design of the leading edge and double-curvature of the blade at the impeller inlet on the polytropic efficiency of the impeller. Curves C1 and C2 represent the polytropic efficiency of an impeller designed according to the present disclosure and according to the state of the art, respectively. The efficiency is reported on the vertical axis ($\eta$), while the flow coefficient is reported on the horizontal axis (Ø). An improved polytropic efficiency is calculated when the novel design is used, in particular at distance from the design point (flow coefficient 100).

Figure 11:
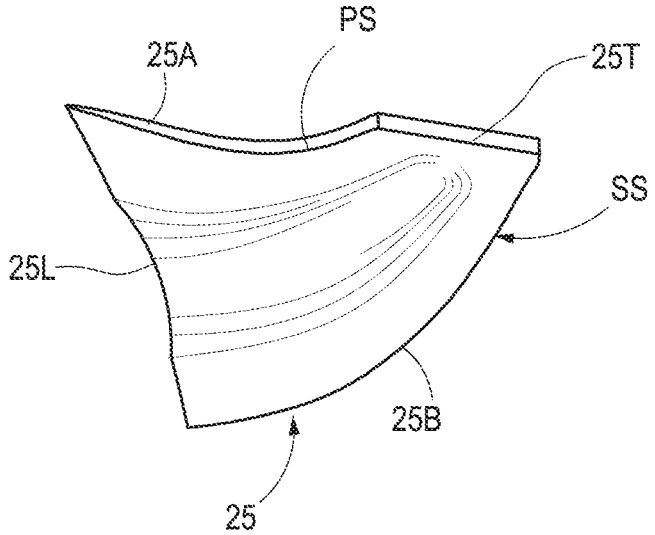
FIG. 11 illustrates a perspective view of a three-dimensional blade according to the present disclosure in a further embodiment.
Figure 12:
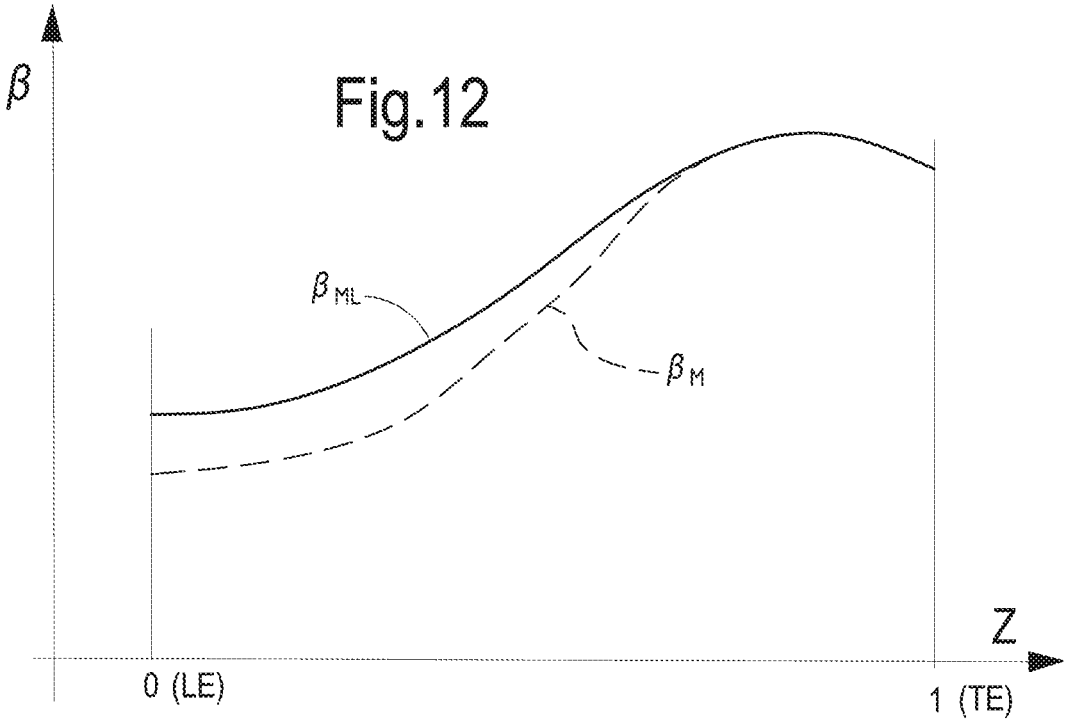
FIG. 12 illustrates a diagram of the metal angle distribution at mid-span along the meridian coordinate of the blade, respectively in a design according to the current art and to the present disclosure, for a blade as shown in FIG. 11.

According to other embodiments, a reverse approach can be used, providing a leading edge which is concave rather than rectilinear in the meridian plane. In this case, the metal angle distribution at mid span in the leading edge area is reduced ("more closed") with respect to the current art. The blade 25 will thus become three-dimensionally curved at least in the area proximate the leading edge, with a concavity on the suction side and a convexity on the pressure side. The effect of broadening of the cross section of the vane between adjacent blades, due to the concave profile of the leading edge, will in this case be compensated by the reduction of the metal angle. Similarly to FIG. 7, FIG. 11 schematically illustrates the shape of a blade with a concave leading edge and correspondingly modified metal angle distribution at mid span. In FIG. 12 the modified metal angle $\beta_M$ distribution compared with the current art metal angle $\beta_{ML}$ distribution is plotted versus the normalized meridian coordinate (Z). At least in the area near, i.e. adjacent the leading edge, the metal angle is smaller than in a blade designed according to the current art, with ruled surfaces on the pressure and suction side.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. Different features, structures and instrumentalities of the various embodiments can be differently combined.

What is claimed is:

1. A centrifugal compressor impeller comprising:
- a gas inlet;
- a gas outlet;
- a disc having a plurality of blades extending therefrom, each blade comprising:
  - a leading edge at the gas inlet;
  - a trailing edge at the gas outlet;
  - a blade base extending along the disc between the leading edge and the trailing edge;
  - a blade tip extending between the leading edge and the trailing edge opposite the disc;
  - a pressure side; and
  - a suction side;
  - wherein the leading edge of each blade has a curved, non-linear profile in a meridian plane;
  - wherein starting at the leading edge and for at least a blade portion, each blade has a first metal angle distribution at the blade base, a second metal angle distribution at the blade tip and at least a third metal angle distribution at an intermediate location between the blade base and the blade tip, the third metal angle distribution comprising a U-shaped indentation extending from the leading edge and terminating prior to the trailing edge;
  - wherein the third metal angle distribution is selected as a function of the curved, non-linear profile of the leading edge and is greater than the first metal angle distribution and the second metal angle distribution; and
  - wherein the blade portion has a double curvature.

2. The impeller of claim 1, wherein the curved, non-linear profile of the leading edge is convex and wherein the third metal angle distribution is selected such that in the intermediate location each blade has a convex surface on the suction side and a concave surface on the pressure side.

3. The impeller of claim 1, wherein the curved, non-linear profile of the leading edge is concave and wherein the third metal angle distribution is selected such that in the intermediate location each blade has a convex surface on the pressure side and a concave surface on the suction side.

4. A centrifugal compressor comprising at least one centrifugal compressor impeller according to claim 1, and a diffuser arranged around the gas outlet of the at least one centrifugal compressor impeller.

5. A centrifugal compressor comprising at least one centrifugal compressor impeller according to claim 2, and a diffuser arranged around the gas outlet of the at least one centrifugal compressor impeller.

6. A centrifugal compressor comprising at least one centrifugal compressor impeller according to claim 3, and a diffuser arranged around the gas outlet of the at least one centrifugal compressor impeller.

7. The impeller of claim 1, wherein, for each blade, the first metal angle distribution at the blade base and the second metal angle distribution at the blade tip are different.

8. The impeller of claim 1, wherein, for each blade, the first metal angle distribution at the blade base and the second metal angle distribution at the blade tip are the same.

9. The impeller of claim 2, wherein, for each blade, the first metal angle distribution at the blade base and the second metal angle distribution at the blade tip are different.

10. The impeller of claim 2, wherein, for each blade, the first metal angle distribution at the blade base and the second metal angle distribution at the blade tip are the same.

11. The impeller of claim 3, wherein, for each blade, the first metal angle distribution at the blade base and the second metal angle distribution at the blade tip are different.

12. The impeller of claim 3, wherein, for each blade, the first metal angle distribution at the blade base and the second metal angle distribution at the blade tip are the same.

13. A method for designing a compressor impeller with a plurality of impeller blades, the method comprising:

for each impeller blade, defining a blade base profile along an impeller disk and a blade tip profile in a meridian plane;

defining a pressure side surface and a suction side surface of each of the plurality of impeller blades extending between the blade base profile and the blade tip profile, the pressure side surface and the suction side surface extending between a trailing edge and a non-linear leading edge, wherein the non-linear leading edge is curved in the meridian plane;

imparting to each blade, starting from the non-linear leading edge towards the trailing edge, a first metal angle distribution at a blade base, a second metal angle distribution at a blade tip and at least a third metal angle distribution at an intermediate location between the blade base profile and the blade tip profile, wherein the third metal angle distribution is selected as a function of a profile of the non-linear leading edge and is greater than the first metal angle distribution and the second metal angle distribution, wherein the third metal angle distribution comprises a U-shaped indentation extending from the non-linear leading edge and terminating prior to the trailing edge; and, a blade portion adjacent the non-linear leading edge having a double curvature.

14. The method of claim 13, wherein each non-linear leading edge has a convex shape in the meridian plane and the third metal angle distribution is selected such that the intermediate location of each impeller blade has a convex surface comprising the suction side surface and a concave surface on the pressure side surface at least in a region adjacent the non-linear leading edge.

15. The method of claim 13, wherein the non-linear leading edge of each impeller blade has a concave shape in the meridian plane and the third metal angle distribution is selected such that the intermediate location of each impeller blade has a concave surface on the suction side surface and a convex surface on the pressure side surface at least in a region adjacent the non-linear leading edge.

16. The method of claim 13, wherein, for each blade, the first metal angle distribution at the blade base and the second metal angle distribution at the blade tip are different.

17. The impeller method of claim 13, wherein, for each blade, the first metal angle distribution at the blade base and the second metal angle distribution at the blade tip are the same.

* * * * *